US005395166A

United States Patent [19]

Watson

[11] Patent Number: 5,395,166

[45] Date of Patent: Mar. 7, 1995

[54] NAIL TECHNICIAN/CLIENT MOBILE TRAY

[76] Inventor: Harriett M. Watson, 102 Greenpine Ct. #2B, Baltimore, Md. 21244

[21] Appl. No.: 57,570

[22] Filed: Jun. 6, 1993

[51] Int. Cl.[6] ..... A47B 3/10

[52] U.S. Cl. ..... 312/244; 312/287; 312/351.6

[58] Field of Search ..... 312/244, 259, 209, 241, 312/287, 351.6

[56] References Cited

U.S. PATENT DOCUMENTS

| | | | |
|---|---|---|---|
| 1,838,558 | 12/1931 | Kolodny | 312/258 |
| 2,461,177 | 2/1949 | Prestien | 312/244 |
| 2,797,137 | 6/1957 | Forde . | |
| 3,132,439 | 5/1964 | McGill | 312/244 |
| 3,305,076 | 2/1967 | Fleenor . | |
| 3,352,616 | 11/1969 | Linger | 312/244 |
| 3,923,356 | 12/1975 | Washburne | 312/244 X |
| 4,283,098 | 8/1981 | Sun | 312/244 X |
| 4,296,766 | 10/1981 | Benis . | |
| 4,312,507 | 1/1982 | Smith et al. . | |
| 4,538,861 | 9/1985 | Hughes, Jr. . | |
| 4,813,521 | 3/1989 | Goldstone | 312/244 X |
| 5,184,795 | 2/1993 | Sexton | 248/118 |

*Primary Examiner*—Edward K. Look
*Assistant Examiner*—Hoang Nguyen
*Attorney, Agent, or Firm*—Robert E. Bushnell

[57] ABSTRACT

A tray (10) for use in the various activities of a nail technician or manicurist, in particular for expeditious convenience of artificial nail application products, supplies, nail art painting and jewelry supplies. The tray is designed to rest on the lap of the nail-technician with the longer of two sides (12, 14) positioned adjoining the torso of the technician, and includes two side drawers (24, 26) on the right and left sides so as to be accessible while the tray (10) remains stationary on the lap of the technician. The tray (10) also includes a top compartment storage area (50) and brush and file posts (36) which holds implements in an upright position for easy accessibility. The tray is of a trapezoidal shape and includes three deep recessed areas (32) to hold bottles etc., in an upright position; a portable lamp may be attached. When necessary, hinged extendible legs are provided on the underside as well as a non-skid material undersurface.

20 Claims, 4 Drawing Sheets

NAIL TECHNICIAN/CLIENT MOBILE TRAY

This application makes reference to, incorporates the same herein, and claims all benefits incurring thereby, of a Disclosure Statement filed in the United States Patent & Trademark Office on or about 24 Jan. 1992 and assigned disclosure document No. 299,466, and a Disclosure Statement of an improvement thereon filed in the United States Patent & Trademark Office on or about 8 Sep. 1992 and assigned disclosure document No. 320902.

BACKGROUND OF THE INVENTION

1. Technical Field

The present invention relates to a portable manicurist's tray, and more particularly, to a lap-held tray providing a compact, portable and complete work station comfortably accommodating both a manicurist and a client during use at a job site while facilitating travel between job sites.

2. Background Art

Conventional designs of tables and other work stations for nail-technicians and manicurists tend to rely upon either stationary cabinets or relatively large, caster mounted tables. Changes in society have occasioned manicurists travelling to visit clients residing in retirement villages or in nursing homes, or in attendance at senior centers. Consequently, a manicurist may visit two or more sites during the course of a single day and must pack and transport supplies and utensils between the sites. Movable, caster mounted tables such as the *Manicure Table* disclosed in Cowen, et al. U.S. Pat. No. 4,329,002 are not readily amenable due to their size and weight, to rapid and repeated transportation outside of the environment of a salon and between multiple job sites during the course of a working day. Other designs such as the *Manicure Table* of DeLapp, U.S. Pat. No. 3,784,270, require storage drawers to open towards the manicurist and are not therefore, suitable for close engagement of the table-top working surface by the manicurist; in essence, the opening of one or more storage drawers forces the manicurist away from the table. Moreover, although currently available manicurist's tables provide for some storage of supplies and utensils, such tables contemplate a single upright orientation during both use and travel, and do not permit shifts of that upright orientation during travel between job sites.

SUMMARY OF THE INVENTION

It is therefore, one object of the present invention to provide an improved work station for a manicurist.

It is another object to provide a compact, portable tray for a manicurist.

It is still another object to provide a manicurist's tray that may be supported upon the lap of the manicurist while working upon the hands of a client.

It is yet another object to provide a manicurist's tray that accommodates an exposed placement of supplies and utensils while the tray is supported upon the lap of the manicurist.

It is still yet another object to provide a manicurist's tray that can be quickly packed, up-ended and carried by hand between job sites.

It is a further object to provide a manicurist's tray that permits ready access to storage drawers while the tray is in use and supported upon the lap of a manicurist.

It is a still further object to provide a manicurist's tray that provides secure and comfortable support for a client's wrists while the tray is in use and supported upon the lap of a manicurist.

It is a still yet further object to provide a manicurist's tray that can be up-ended and carded by hand between job sites while simultaneously providing storage of supplies and utensils.

These and other objects may be achieved according to the principles of the present invention with a tray having a first and major side facing toward the manicurist and a second and lesser side facing toward the client, with a plurality of drawers for storage of supplies and utensils disposed to open from minor sides of the tray positioned between the first and second sides. The tray provides an upper work surface bordered by grooves to hold supplies and by apertures disposed to hold utensils and brushes in an ordered array, while a wrist rest to cushion the forearms of the client is positioned along to the second side. The compactness of the tray enables the tray to be supported upon the lap of the manicurist during use. A handle attached to the second side permits the tray to be up-ended, by lifting, from its normal work station orientation, and carried by hand between work sites, while the first side provides a base surface to allow the tray to stand with a vertical orientation after being up-ended.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
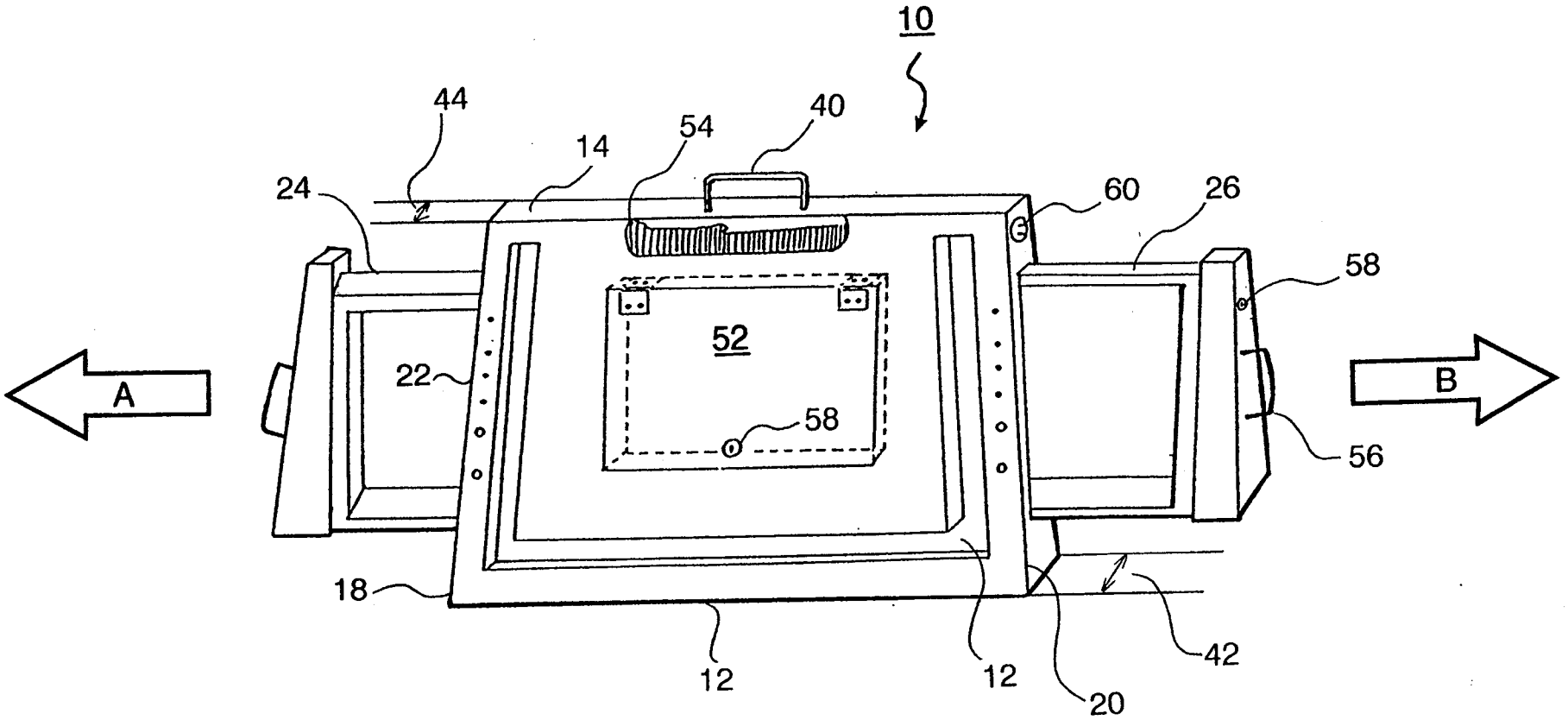
FIG. 1 is a perspective elevational view illustrating the structure of one embodiment constructed according to the principles of the present invention.
Figure 2:
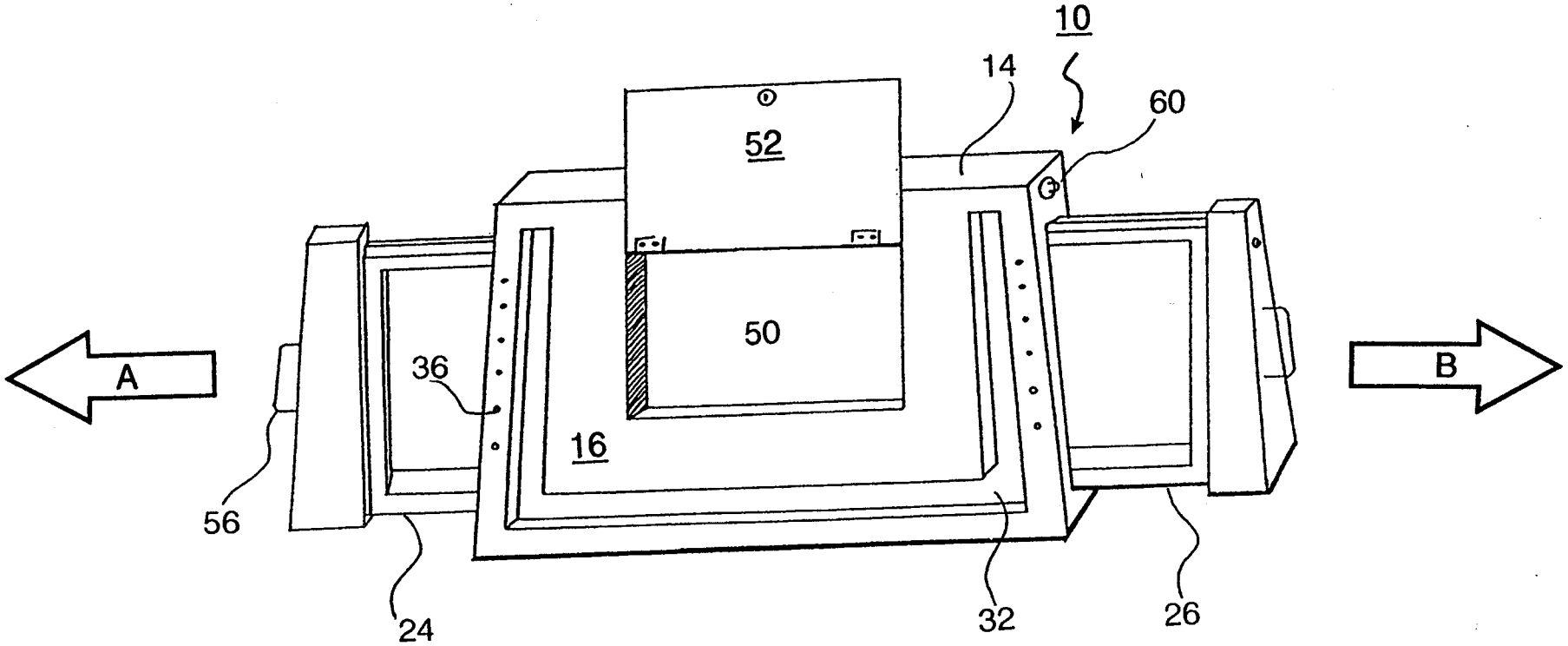
FIG. 2 is another perspective elevational view illustrating the embodiment of FIG. 1 in a different configuration.

Turning now to the drawings, FIGS. 1 and 2 show, in perspective elevations, one embodiment instructed according to the principles of the present invention. Generally, a manicurist's tray 10 is constructed as a quadrilateral with nominally parallel first 12 and second 14 major side surfaces spaced-apart on opposite sides of a top working surface 16. First side surface 12 is substantially longer in length than the second side surface 14, in order to better distribute the weight upon the lap of a manicurist while providing the manicurist with the convenience of a greater portion of working surface 16. Two minor side surfaces 18, 20 extend between the first and second side surfaces 12, 14 and complete the periphery of working surface 16. Each of the minor side surfaces 18, 20 are perforated by one or more openings 22 accommodating lateral movement of side drawers 24, 26 along substantially opposite directions of travel indicated by arrows A, B, respectively.

Figure 8:
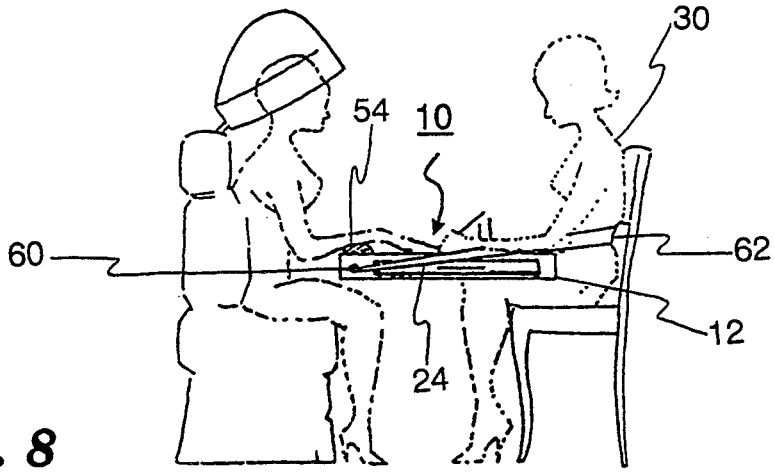
FIG. 8 is an elevational view showing one embodiment of the present invention in use.

Referring briefly now to FIG. 8 in conjunction with FIGS. 1 and 2, when in use tray 10 may be wholly supported by the lap of a manicurist. Preferably the undersuface of tray 10 is formed with a material tending to resist, or retard, sliding movement from the lap of the manicurist. Disposition of the longer first side surface 12 adjacent to the torso of the manicurist tends to maximize the distribution of weight upon the upper portion of the lap of the manicurist. When tray 10 is supported upon the lap of a seated manicurist 30, with the first major side surface 12 adjacent to the lower torso of manicurist 30, side drawers 24 and 26 may be opened, and closed, by the manicurist without changing the disposition of first side surface 12 relative to the lower torso of manicurist 30. In essence, the paths of travel A, B of drawers 24, 26 respectively lie between the substantially parallel first and second side surfaces 12, 14.

Figure 3:
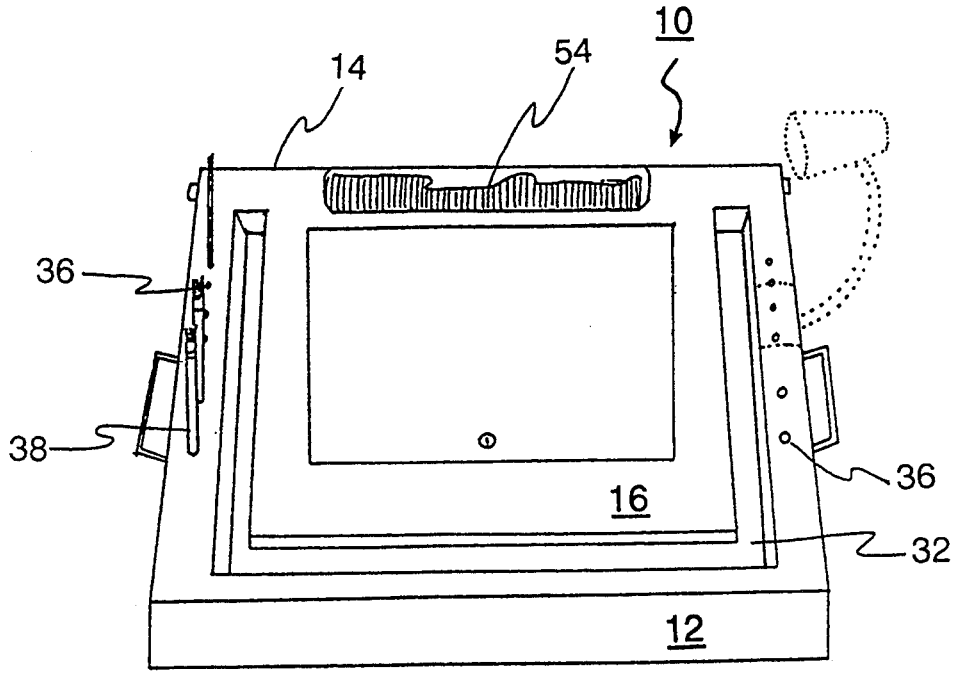
FIG. 3 is a front perspective view illustrating a second embodiment of the present invention.
Figure 4:
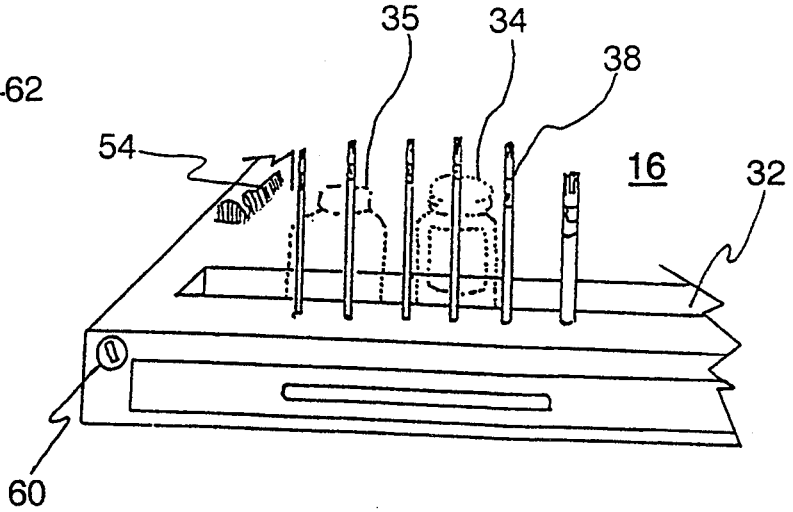
FIG. 4 is a partially cut-away perspective view illustrating details of the present invention.

Referring now briefly to FIG. 4, in conjunction with FIGS. 1, 2 and 3, either a single continuous (e.g., U-shaped) groove 32 recessed into the top surface 16, or a plurality of grooves (not shown) border top surface 16 on all but the region adjacent to the second side surface 14. Groove 32 is configured to accommodate small containers 34, 35 of supplies such as nail polish, lacquers, alcohol and other supplies used during treatment of a client's nails. A plurality of discrete, up-right holes 36 (preferably, of several different diameters) are formed in ordered arrays along the minor side surfaces 18, 20, between groove 32 and side surfaces 18, 20, to hold brushes, implements and utensils in the up-right positions shown in FIG. 4.

Figure 5:
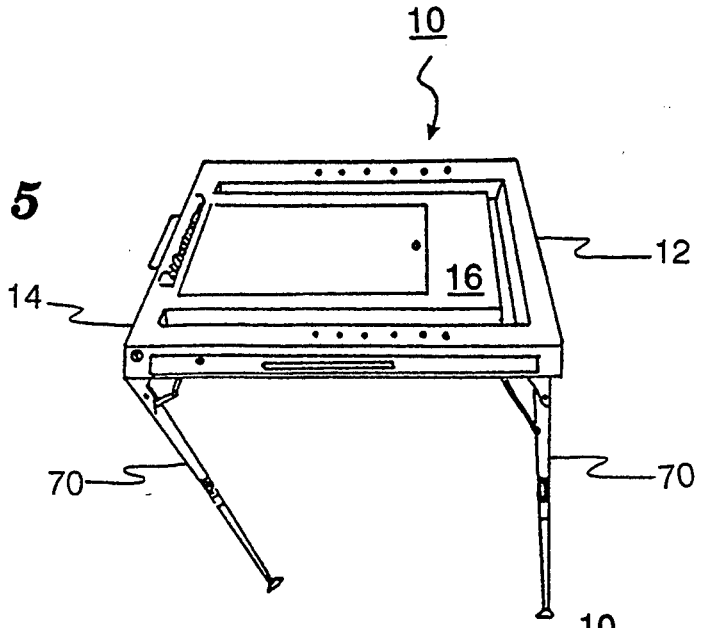
FIG. 5 is a perspective view illustrating a third embodiment constructed according to the principles of the present invention.

Referring now to FIGS. 1, 3 and 5, a handle 40 may be attached to the second side surface 14. Handle 40 enables tray 10 to be lifted from a first, or working, orientation as is show in FIGS. 5 and 8 for example, to the second, or up-right, orientation show in FIGS. 1 and 2. In the second, or up-right, orientation shown in FIGS. 1 and 2 tray 10 rests upon its first side surface 10, thereby enabling a user to grasp handle 40 and to tote tray 10 as a piece of luggage. Materials, brushes, implements and supplies may be stored in side drawers 24, 26 while tray 10 is transported from one assignment to the next. The width 42 of first side surface 12 is greater than the width 44 of the second side surface 14, thereby providing a wide base when tray 10 is standing in the up-right orientation shown in FIGS. 1 and 2, thereby minimizing the risk of tray 10 tipping over while in the up-right orientation shown.

Optionally, a well 50 may be formed, possibly centrally disposed within the top working surface 16, thereby providing additional storage space which is readily accessible to the manicurist during a manicure of a client's nails. A lid 52 may be hinged to allow the lid to open toward the manicurist, thereby giving the manicurist access to the materials within well 50 without disturbing the client.

A wrist rest cushion 54 may be (preferably, temporarily) attached to working surface 16 adjacent to the second side edge 14. During use, the wrist of a client will rest upon cushion 54, thereby allowing the client to comfortably maintain both hands oriented toward the manicurist, within the working area of top surface 16.

Side drawers 24, 26 may be fitted with locks and keys 58, as may be lid 52, thereby discouraging pilferage while tray 10 is out-of-use or in storage, as well as securing the contents of drawers 24, 26 and well 50 while tray 10 is in the up-right orientation, either during transit or while in storage.

Figure 1A:
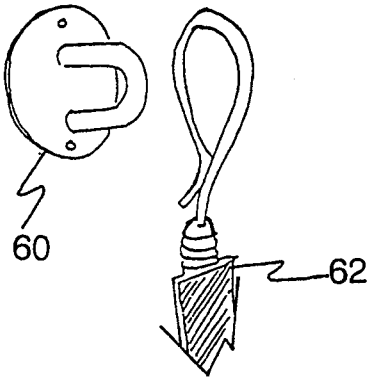
FIG. 1A is a plan view showing one detail of a component suitable for use with the embodiment.

Referring again to FIGS. 1, 2 and 8, but now in conjunction with FIG. 1A, a pair of brackets 60 may be attached to the distal in portions of minor side surfaces 18, 20, or optionally, to the adjacent portion of top surface 16. A strap 62 may be attached to extend between both brackets 60 and around the back of the upper torso of manicurist 30 while tray 10 is positioned upon the lap of manicurist 30. Brackets 60 and strap 62 provide even greater stability for tray 10 while it is in its working orientation.

Figure 6:
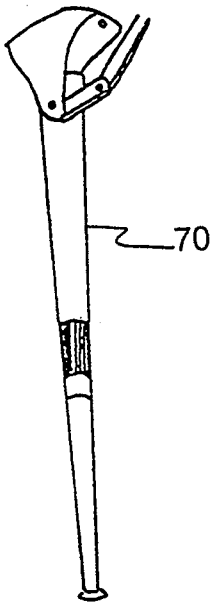
FIG. 6 is a perspective view of one component suitable for use with the embodiment shown in FIG. 5.
Figure 7:
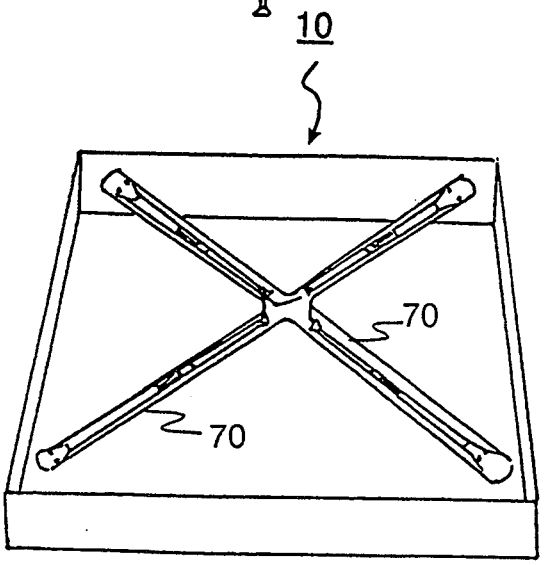
FIG. 7 is another perspective view of the embodiment shown in FIG. 5.

Referring now to FIGS. 5, 6 and 7 either a single, or a plurality of collapsible, or foldable, legs 70 may be attached to the under-side surface. When in the working orientation, legs 60 may be unfolded and disposed to stand vertically, thereby extending between tray 10 and the underlying floor, and thus supporting tray 10 in a substantially horizontal, working configuration as shown in FIG. 5. When tray 10 is not in service, legs 70 may be folded, or otherwise collapsed, and placed in the configuration shown in FIG. 7 beneath tray 10, thereby enabling tray 10 to be easily transported, as well as stored with a minimal bulk.

The trapezoid shape of the embodiment of the invention provides the longer side 12 for the nail-technician's arm movement, with the shorter side being for the client. Referring again to FIG. 1A, a strap 62 with belt attachment is provided on both the left and fight sides for the nail-technician to keep the tray steady while filing and performing other functions. The adjustable strap will fit around the nail-technician's body and connect to the two side attachments 60 which will insure the steadiness of the tray. Two drawers with lock and key am provided on both the left and right side which will assure easy accessibility without having to be removed from the lap. An optional top compartment with lock and key will lay fiat with the horizontal surface of the for additional space. To the left and right of the top surface of there are a number of brush post holes to keep all brushes in an up-right position, e.g., sculpturing, gel, nail art painting or filing. Three sides of the tray have deep recessed areas, excluding the client's side. These areas are provided to accommodate the various bottles of liquids, powders, gels, etc. The bottom of the recessed areas may be lined with a removable non-skid perforated material that will keep bottles, dampen dishes, etc in place or stationery. Folding legs are provided on the underside in case their use becomes necessary and a non-skid material is on the underside for when the legs are not in use.

Many optional uses are possible according to the supplies and products that will be used. This invention is made even more functional by the nail-technicians' own knowledge of the services performed most frequently.

One who is knowledgeable and or skilled in the art of manicuring and in particular in the art of modem day nail technology with its array of artificial nail and nail products can readily see the many advantages, conveniences and optional functions of this invention. Primarily, this device will save time and effort within the industry and since time is money in this industry, the use of this tray will allow the nail-technician to provide more services to their clients and thus increase their revenues. The nail-technician will no longer have to retrieve needed supplies from the stationery manicuring table or the cumbersome table on wheels to complete the service on a client because the regular table is too large or cumbersome to follow a client getting other services, e.g., hair, to another area of the salon. The nail-technician will no longer have to carry a heavy cumbersome table to businesses or residences if he/she is a self employed traveling nail-technician, because this portable tray has the compartments to store all the necessary supplies if it is necessary to move around. One who is skilled in the art knows that this device will always be well stocked and in a ready position within a salon setting, and can be easily made ready when arriving at a particular destination.

This device is functional like no other on the market today. Some tables may be small and portable but they lack room for storage or for brushes in an up-right position and cannot go with the nail-technician into tight quarters within a salon. This invention will be expedient in salons with limited space. Furthermore, the close tight drawers allows for multi-state sterilization of implement requirements e.g., the use of formaldehyde crystals or tablets etc. Liquids may be used in air tight containers which are available on the open market. This tray is designed to use supplies in a miniature form.

Some of the optional features suitable for the practice of this invention may be obtained and are presently on the open market today, e.g., a detachable lamp (shown in outline in FIG. 3), belts and straps and attachable cushions. The tray may be made in various lengths and widths in the trapezoidal shape and a deluxe model may include all the mentioned embodiments, whereas, another model may be made to exclude some. Ideally all models should include two side drawers the recessed areas and brush, file posts and strap attachments. Another optional feature includes an air-vent system which would be located in the top compartment storage area with either a fan either powered by a battery or via house current via an extension cord, mounted below top surface 16, to draw volatile fumes away from the work area. Alternatively, louvers fitted within top surface 16 could be connected to an exhaust duct emerging through the bottom surface of tray 10, and the exhaust duct coupled via flexible tubing, to a portable air pump to serving as an exhaust fan.

What is claimed is:

1. A tray, comprising:

a top surface;

a first surface exhibiting a major length along a first side of said top surface, a second surface exhibiting a lesser length along a second side of said top surface, said second surface being spaced apart from said first surface;

a plurality of drawers disposed beneath said top surface;

a plurality of minor surfaces extending between opposite ends of said first and second surfaces and accommodating opening of said plurality of drawers along paths of travel lying between said first and second surfaces; and means attached to said second surface for enabling lifting of said tray by rotating said first surface from a working orientation to a travelling orientation substantially perpendicular to said working orientation.

2. The tray of claim 1, further comprising:

a continuous aperture providing a first open volume disposed within said top surface and extending along one of said minor surfaces; and a plurality of discrete second apertures providing a second and lesser open volume, disposed in a spaced apart array along one of said minor surfaces.

3. The tray of claim 1, further comprising:

a pair of continuous apertures providing first open volumes disposed within said top surface and extending along a pair of said minor surfaces; and a plurality of discrete second apertures providing second and lesser open volumes, disposed in spaced apart arrays along said pair of said minor surfaces.

4. The tray of claim 1, further comprising:

a pair of continuous apertures providing a first open volume disposed within said top surface and extending along a pair of said minor surfaces and said first surface; and a plurality of discrete second apertures providing second and lesser open volumes, disposed in spaced apart arrays along said pair of said minor surfaces.

5. The tray of claim 1, further comprising:

a pair of brackets attached to said tray at positions closer to said second surface than to said first surface; and means for engaging said pair of brackets and for extending as a strap between said brackets and the torso of a human positioned adjacent to said first surface.

6. The tray of claim 1, further comprising means forming a lower surface of said tray, for retarding movement of said tray from a lap of a human.

7. The tray of claim 1, further comprising a plurality of supporting means attached to said tray, for supporting said tray by vertically extending between said tray and a floor while said first surface is in said working orientation, and for collapsing into horizontal dispositions while said first surface is in said traveling orientation.

8. The tray of claim 1, further comprising:

a well formed within said top surface; and a lid forming a portion of said top surface and covering said well.

9. The tray of claim 1, further comprising a cushion positioned upon said top surface and aligned along an edge formed between said top surface and said second surface.

10. A tray, comprising:

a top surface;

a first surface exhibiting a major length along a first side of said top surface, a second surface exhibiting a lesser length along a second side of said top surface, said second surface being spaced apart from said first surface;

a plurality of drawers disposed beneath said top surface;

a plurality of minor surfaces extending between opposite ends of said first and second surfaces and accommodating opening of said plurality of drawers along paths of travel lying between said first and second surfaces;

a continuous groove providing a first open volume disposed within said top surface and extending along a pair of said minor surfaces and said first surface;

a plurality of discrete second apertures providing second and lesser open volumes, disposed in spaced apart arrays along said pair of said minor surfaces; and means attached to said second surface for enabling lifting of said tray while rotating said first surface from a working orientation to a travelling orientation substantially perpendicular to said working orientation.

11. The tray of claim 10, further comprising:

a pair of brackets attached to said tray at positions closer to said second surface than to said first surface; and means for engaging and extending as a strap between said brackets and the torso of a human positioned adjacent to said first surface.

12. The tray of claim 10, further comprising a lamp flexibly attached to said tray and positionable to illuminate said top surface.

13. The tray of claim 10, further comprising means forming a lower surface of said tray, for retarding movement of said tray from a lap of a human.

14. The tray of claim 10, further comprising a plurality of supporting means attached to said tray, for supporting said tray by vertically extending between said tray and a floor while said first surface is in said working orientation, and for collapsing into horizontal dispositions while said first surface is in said traveling orientation.

15. The tray of claim 10, further comprising:

a well formed within said top surface; and a lid forming a portion of said top surface and covering said well.

16. The tray of claim 10, further comprising air venting means connectable to said tray, for drawing fumes from said to surface.

17. A tray, comprising:

a top surface;

a first surface exhibiting a major length along a first side of said top surface, a second surface extending substantially parallel to said first surface and exhibiting a lesser length along a second side of said top surface, said second surface being spaced apart from said first surface;

a plurality of drawers disposed beneath said top surface;

a plurality of minor surfaces extending between opposite ends of said first and second surfaces and accommodating opening of said plurality of drawers along directionally opposite paths of travel substantially parallel to and lying between said first and second surfaces;

said first surface having a first orientation with said top surface providing a work area while said first surface is in said first orientation, and said first surface having a second orientation substantially perpendicular to said first orientation while said first surface serves as a base supporting said tray in an up-right position;

first recessed means providing a first open volume disposed within said top surface and extending along a pair of said minor surfaces, for accommodating a plurality of containers while said first surface maintains said first orientation; and second recessed a plurality of discrete second apertures providing second and lesser open volumes, disposed in spaced apart arrays along one of said minor surfaces, for holding proximal ends of brushes in up-fight orientations while said first surface maintains said first orientation.

18. The tray of claim 17, further comprising:

a pair of brackets attached to said tray at positions closer to said second surface than to said first surface; and means for engaging said pair of brackets and for extending as a strap between said brackets and the torso of a human positioned adjacent to said first surface.

19. The tray of claim 17, further comprising means forming a lower surface of said tray, for retarding movement of said tray from a lap of a human.

20. The tray of claim 17, further comprising a plurality of supporting means attached to said tray, for supporting said tray by vertically extending between said tray and a floor while said first surface is in said first orientation, and for collapsing into a horizontally disposed configuration while said first surface is in said second orientation.

* * * * *